United States Patent [19]

Przygocki

[11] 4,021,970

[45] May 10, 1977

[54] WIDE ABRASIVE BELT TENSION AND OSCILLATION ASSEMBLY

[75] Inventor: Witold C. Przygocki, Southfield, Mich.

[73] Assignee: Acme Mfg. Company, Ferndale, Mich.

[22] Filed: Feb. 19, 1976

[21] Appl. No.: 659,228

[52] U.S. Cl. ..... 51/148; 51/135 BT

[51] Int. Cl.[2] ..... B24B 21/18

[58] Field of Search ..... 51/135 BT, 148

[56] References Cited

UNITED STATES PATENTS

| | | | |
|---|---|---|---|
| 2,597,256 | 5/1952 | Murray | 51/142 |
| 3,504,458 | 4/1970 | Rutt | 51/135 BT |
| 3,665,650 | 5/1972 | Przygocki | 51/142 |

*Primary Examiner*—Harold D. Whitehead
*Assistant Examiner*—Roscoe V. Parker
*Attorney, Agent, or Firm*—Harness, Dickey & Pierce

[57] ABSTRACT

An abrasive belt tension and oscillating assembly for use with wide belts resulting in the use of long and heavy rolls and mounting frames requiring heavy duty supports for the ends of the pivotally mounted tension roll and further requiring stabilizers in the form of dual guide pins with rack and gear construction for uniform movement of the idle or tension roll assembly and uniform tension on the belt regardless of the width and position of the belt.

4 Claims, 3 Drawing Figures

WIDE ABRASIVE BELT TENSION AND OSCILLATION ASSEMBLY

BACKGROUND OF THE INVENTION

Heretofore, in polishing or grinding metal sheets or plates, the sheets have been relatively narrow and, consequently, the belts, rolls and mounting assemblies have been correspondingly narrow. In such prior assemblies, it was recognized that there be belt tensioning means and also that the belt be mounted on an oscillating idle or tension roll, with the oscillation controlled to effect the oscillatory movement of the endless abrasive belt. Such prior art devices are disclosed in U.S. Pat. No. 2,597,256 and U.S. Pat. No. 3,665,650. The belts and rolls of such patents may be up to approximately 72 inches long maximum with each roll assembly, including roll and mounting frames or brackets, weighing about 3000 pounds.

SUMMARY OF THE INVENTION

In the structure of this invention, the rolls and mounting assemblies are constructed to accommodate belts of considerably greater width so that workpieces of considerably greater width may be processed. This results in much more massive rolls and mounting frames. By way of example, in one machine constructed according to this invention, the rolls are 130 inches long, with the movable tension roll weighing 2000 pounds and the movable mounting bracket, 3000 pounds. There is up to 100 pound/inch tension on the belt and a total of 12,000 pounds tension on the cylinder.

The idle roll is mounted to pivot about its longitudinal center under controlled oscillation and is supported adjacent both outer ends by heavy duty roller-type bearings so that the massive roll assembly may function properly to maintain proper belt tension.

Also, means are provided to move the idle roll assembly relative to the driven contact roll to apply proper tension on the belt, with stabilizers adjacent the ends of the rolls in the form of dual guide pins interconnected by rack and gear construction to assure uniform movement of the idle roll assembly along its length and uniform belt tension regardless of the width and position of the belt.

DESCRIPTION OF THE PREFERRED EMBODIMENTS

Figure 1:
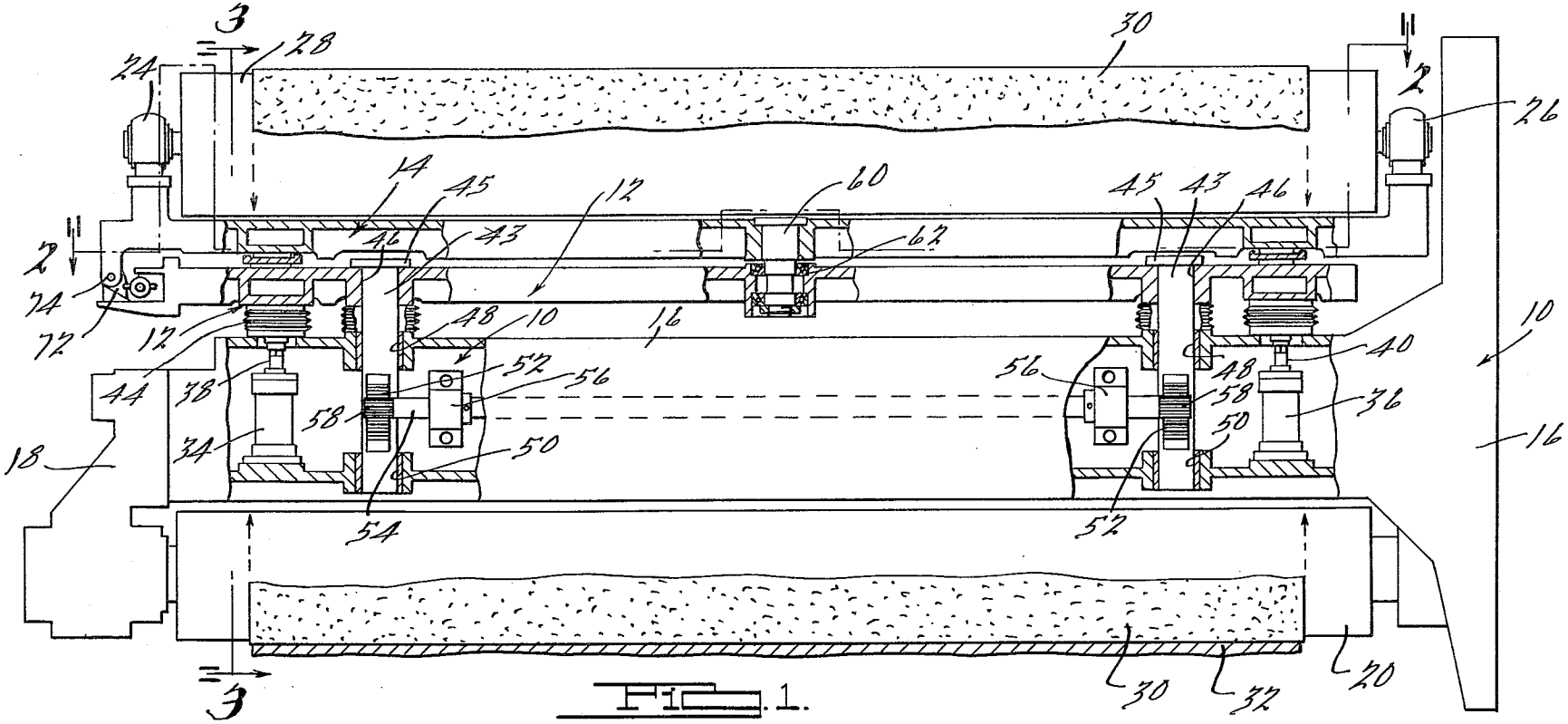
FIG. 1 is a front elevational view of the assembly with parts removed and showing parts in cross-section.
Figure 2:
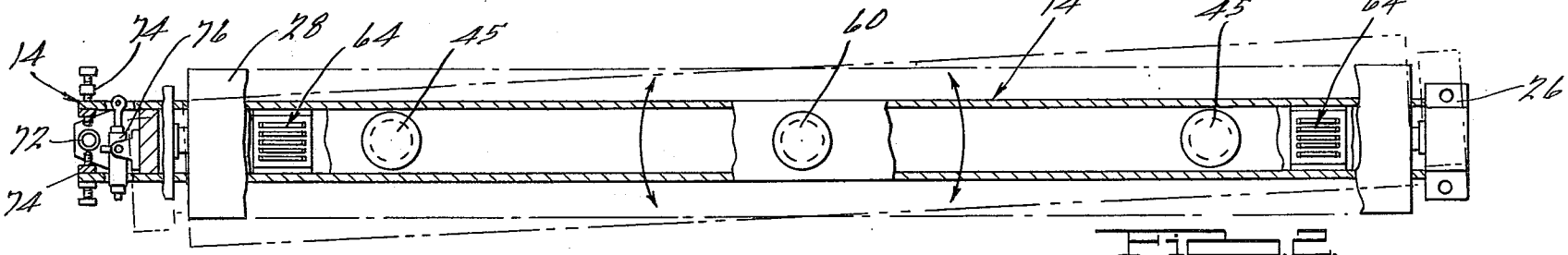
FIG. 2 is a top plan and cross-sectional view taken substantially along the line 2—2 of FIG. 1.

The belt tension and oscillation assembly comprises a head assembly generally indicated at 10 having a lower support frame generally indicated at 12 superimposed above the assembly 10. A tension roll and upper oscillating support frame is generally indicated at 14 and is disposed above the lower support frame 12 and supported thereby for oscillating movement with respect thereto.

The assembly 10 includes a tension roll housing 16, the main portion of which projects as a cantilever structure with a removable outboard spindle bearing assembly 18 disposed at the opposite end.

The contact roll 20 is supported in bearings in the housings 16 and 18; and a drive motor (not shown) is mounted outwardly of the housing and connected to the adjacent end of the roll 20 for driving the contact roll. The contact roll 20 preferably has a resilient covering such as neoprene.

The roll supporting frame 12 is disposed above the projecting portion of the housing 16 and is mounted for movement toward and away from housing 16. The frames 12 and 14 form an idle roll assembly and move together toward and away from the underlying frame 16.

The upper supporting frame 14 has bearings 24 and 26 mounted at the ends for rotatably supporting journals of the idle or tension roll 28. The idle roll 28 is substantially the same length as the contact roll 20. An endless abrasive belt 30 is disposed around rolls 20 and 28 and travels around such rolls when the roll 20 is driven to contact a workpiece 32 which may be supported by a table, roller, or other means. Such workpiece may be in the form of a coiled strip, plate, or the like.

The assembly 10 and the main frame 16 may be mounted on a supporting frame on the floor either for adjustment with respect to the floor frame to control the work pressure on the workpiece 32 or may be in a fixed position relative to the floor frame with the support for the workpiece adjusted to control work pressure.

Figure 3:
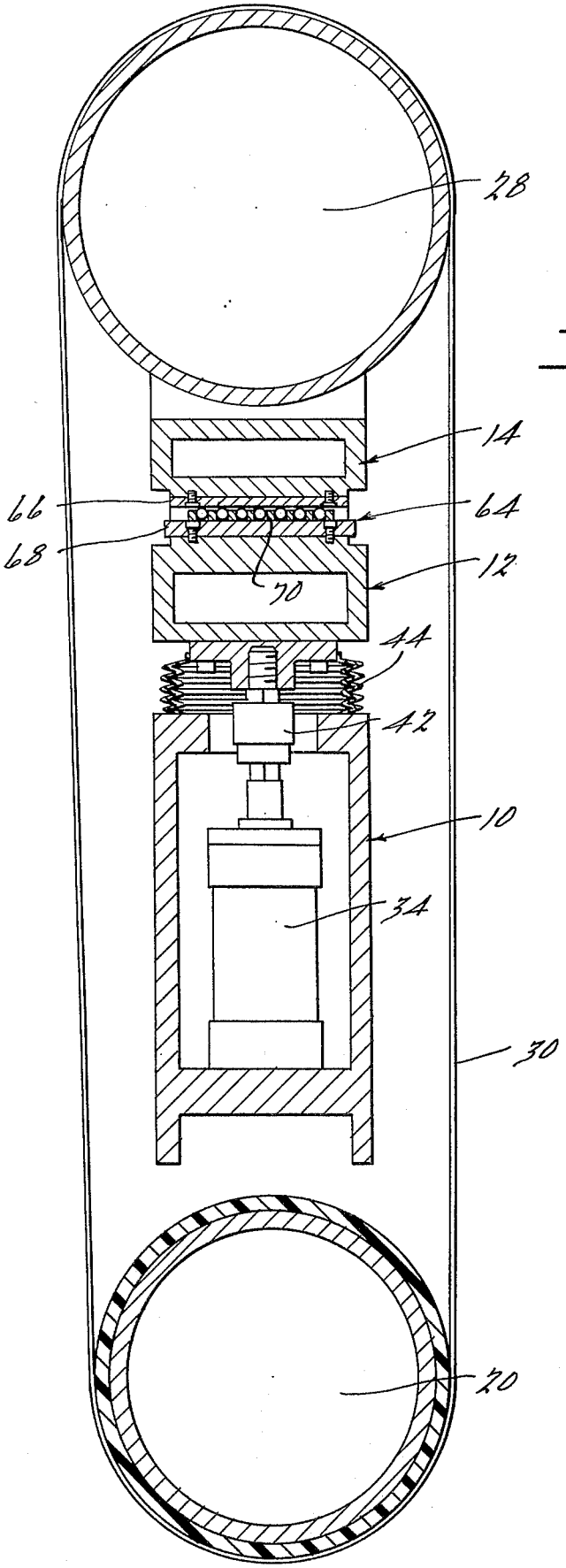
FIG. 3 is an enlarged cross-sectional view taken substantially along the line 3—3 of FIG. 1.

The lower support frame 12 is moved toward and away from the underlying main frame 16, with the upper support frame 14 moving therewith, by means of dual hydraulic cylinders 34 and 36 mounted on the main frame adjacent the outer ends thereof. Piston rods 38 and 40, respectively, are connected to the underside of the lower support frame 12 through a floating connector 42, as best shown in FIG. 3. The floating connector 42 is a standard market item and is disposed in the connection between cylinders 34 and 36 and the lower frame 12 so as to accommodate slight lateral misalignment. Flexible boots 44 surround the upper ends of the hydraulic connection to protect the connection against dirt and abrasives.

The hydraulic cylinders 34 and 36 are manually operated by means of hydraulic valves in order to control the belt tension.

With a massive assembly such as that of the present invention, stabilizers are needed so that there is a uniform movement of the idle roll assembly, consisting of frames 12 and 14 and roll 28, and the belt completely therealong regardless of width and position of the belt. Such stabilizing means comprise a pair of guide pins 43 indicated adjacent the cylinders 34 and 36 inwardly thereof, with the head ends of the pins 45 bolted to the lower support frame 12. The pins extend through openings 46 in the frame 12. The pins project downwardly through guide bushings 48 and 50 in pairs of aligned openings in the main frame 16 so that the guide pins 43 may slide within such bushings during relative movement between frames 12 and 16. p In order to insure uniform movement along the length of the rolls, each of the pins is provided with rack portions 52. A transversely extending rod 54 is mounted within stabilizing journal bearings 56 and the rod 54 has gears or pinions 58 formed in the ends thereof which engage the rack teeth 52.

Thus, as the cylinders 34 and 36 are actuated, the rack and gear stabilizing connection with guide pins 43 assures uniform movement of the idle roll 28 thereacross.

The idle roll 28 is mounted on the support frame 14 which in turn is mounted on the lower frame 12 for pivotal movement with respect thereto. A pivot assembly 60 is disposed midway along the length of the frames 12 and 14 with the lower end of the pivot pin mounted within heavy duty tapered roller bearing assembly 62 mounted in frame 12.

The outer ends of the upper support frame 14 are supported on the lower support frame 12 by means of heavy duty roller-type thrust bearing assemblies indicated at 64. These bearings assemblies include hardened wear plates 66 and 68 fixed to the facing surface of upper support 14 and lower support 12 with the heavy duty roller-type thrust bearings 70 interposed therebetween.

Thus, the upper frame 14 together with the roll 28 may pivot or oscillate with respect to the support frame 12 and the main frame 10.

The oscillation of the idle support frame is limited by stops including a fixed stop 72 mounted on and adjacent one end of frame 12 with adjustable stops 74 mounted on frame 14. The oscillation is effected by a hydraulic cylinder 76 connected between frames 12 and 14 for effecting the tracking of the belt transversely of the rolls and oscillation of the idle rolls. This may be controlled by a pressurized air chamber such as that set forth in U.S. Pat. No. 3,665,650. This oscillation and control does not per se form a part of the present invention and is known in the prior art patent referred to.

From the above description, it will be apparent that the massive structure of this invention which is used with wide belts and, consequently, long and heavy contact and idle rolls with heavy mounting frames are so mounted as to permit belt tracking by oscillation of the tension rolls with the rolls supported adjacent the ends and with uniform movement of the idle roll assembly, regardless of width and position of the belt. That is, belts may be used for the full length of the rolls, or less, with assurance of uniform and proper belt tension.

I claim:

1. A belt tension and oscillation assembly for wide abrasive belt applications comprising a relatively stationary main frame, a contact roll mounted on said main frame, a first support frame mounted on said main frame for linear movement relative thereto, a second support frame mounted on said first support frame for pivotal movement relative to said first support frame and for linear movement with said first support frame relative to said main frame, an idle tension roll mounted on said second support frame, a continuous abrading belt mounted on said rolls, and means interconnecting said main, first and second frames, said last-named means including a pivot connection between said first and second support frames located substantially midway between the ends thereof permitting pivotal movement of said second frame relative to said first support frame, bearing supports interposed between said first and second support frames adjacent the ends thereof to support said second support frame and said idle roll during pivoting thereof, and means to effect relative linear movement between said main frame and said first and second support frames to apply uniform belt tension to said belt.

2. A belt tension and oscillating assembly according to claim 1 in which the means to effect linear movement comprises a pair of hydraulic means disposed in alignment with said bearing supports and interconnects said main frame with said first support frame.

3. A belt tension and oscillating assembly according to claim 1 including interconnected means located adjacent the bearing supports to insure uniform movement of said first frame along its length.

4. A belt tension and oscillating assembly according to claim 3 in which said interconnecting means includes dual guide pins each of which has a rack portion associated with an interconnecting common gear member.

* * * * *